US012038237B2

(12) United States Patent
Song et al.

(10) Patent No.: US 12,038,237 B2
(45) Date of Patent: Jul. 16, 2024

(54) HEAT EXCHANGER, MODULAR INDIRECT EVAPORATION COOLING SYSTEM, AND METHOD FOR CONTROLLING MODULAR INDIRECT EVAPORATION COOLING SYSTEM

(71) Applicant: Huawei Digital Power Technologies Co., Ltd., Shenzhen (CN)

(72) Inventors: Jinliang Song, Xi'an (CN); Lei Ma, Xi'an (CN)

(73) Assignee: Huawei Digital Power Technologies Co., Ltd., Shenzhen (CN)

( * ) Notice: Subject to any disclaimer, the term of this patent is extended or adjusted under 35 U.S.C. 154(b) by 72 days.

(21) Appl. No.: 17/562,762

(22) Filed: Dec. 27, 2021

(65) Prior Publication Data

US 2022/0205729 A1 Jun. 30, 2022

(30) Foreign Application Priority Data

Dec. 28, 2020 (CN) ..... 202011597241.0

(51) Int. Cl.
*F28D 9/00* (2006.01)
*F24F 5/00* (2006.01)
(Continued)

(52) U.S. Cl.
CPC ..... *F28D 9/0031* (2013.01); *F24F 5/0035* (2013.01); *F28C 2001/145* (2013.01); *F28F 3/08* (2013.01); *F28F 3/10* (2013.01)

(58) Field of Classification Search
CPC ... F28F 3/08; F28F 3/10; F28D 9/0031; F24F 5/0035; F28C 2001/145
See application file for complete search history.

(56) References Cited

U.S. PATENT DOCUMENTS 4,301,863 A 11/1981 Bizzarro
7,197,887 B2 * 4/2007 Maisotsenko ..... F24F 5/0035 261/153
(Continued)

FOREIGN PATENT DOCUMENTS

CN 1434263 A 8/2003
CN 101650141 A 2/2010
(Continued)

OTHER PUBLICATIONS

Translation of WO2019124286A1 entitled Translation-WO2019124286A1 (Year: 2023).*

*Primary Examiner* — Paul Alvare
(74) *Attorney, Agent, or Firm* — Leydig, Voit & Mayer, Ltd.

(57) ABSTRACT

Embodiments of this application provide a heat exchanger, a modular indirect evaporation cooling system, and a method for controlling a modular indirect evaporation cooling system, and relate to the field of indirect cooling technologies, to improve cooling efficiency of the modular indirect evaporation cooling system. The heat exchanger includes a first heat exchange core and a second heat exchange core. The first heat exchange core includes a first heat exchange fin and a first seal, where two first seals are disposed opposite to each other and are separately connected to the first heat exchange fin in an intersected manner. The second heat exchange core includes a second heat exchange fin, a second seal, and a heat exchange medium permeability channel, where two second seals are opposite to each other and are separately connected to the second heat exchange fin in an intersected manner.

20 Claims, 11 Drawing Sheets

(51) Int. Cl.

| | |
|---|---|
| ***F28C 1/14*** | (2006.01) |
| ***F28F 3/08*** | (2006.01) |
| ***F28F 3/10*** | (2006.01) |

(56) References Cited

U.S. PATENT DOCUMENTS

| | | | | |
|---|---|---|---|---|
| 2002/0073718 | A1* | 6/2002 | Maisotsenko | F24F 1/0007 62/121 |
| 2002/0164944 | A1* | 11/2002 | Haglid | F28D 19/041 454/228 |
| 2003/0145609 | A1* | 8/2003 | Maisotsenko | F24F 3/1411 62/171 |
| 2005/0132738 | A1* | 6/2005 | Bourne | F24F 1/0059 62/310 |
| 2005/0217303 | A1* | 10/2005 | Gillan | F28D 5/02 62/304 |
| 2006/0156750 | A1* | 7/2006 | Lowenstein | F28D 3/02 62/271 |
| 2009/0007583 | A1 | 1/2009 | Clarkson et al. | |
| 2009/0114369 | A1* | 5/2009 | Kammerzell | F28D 9/0037 165/47 |
| 2010/0018234 | A1* | 1/2010 | Gillan | F24F 1/0007 62/304 |
| 2011/0209858 | A1* | 9/2011 | Konno | F24F 5/0035 165/164 |
| 2015/0052929 | A1* | 2/2015 | Gillan | F24F 5/0035 62/304 |
| 2017/0108276 | A1* | 4/2017 | Seawell | F28F 25/082 |
| 2019/0049187 | A1* | 2/2019 | Zeidner | B64D 13/08 |
| 2019/0113286 | A1* | 4/2019 | Kunze | F28D 21/0015 |
| 2022/0205729 | A1* | 6/2022 | Song | F28D 9/0062 |

FOREIGN PATENT DOCUMENTS

| | | | | | |
|---|---|---|---|---|---|
| CN | 207230773 | U | | 4/2018 | |
| CN | 108680042 | A | | 10/2018 | |
| CN | 208170534 | U | | 11/2018 | |
| CN | 109539637 | A | | 3/2019 | |
| CN | 209783354 | U | | 12/2019 | |
| CN | 210772603 | U | | 6/2020 | |
| JP | 2012159237 | A | * | 8/2012 | |
| JP | 2023105326 | A | * | 7/2023 | |
| WO | WO-0157460 | A1 | * | 8/2001 | F24F 1/0007 |
| WO | WO-2019124286 | A1 | * | 6/2019 | F24F 7/08 |
| WO | WO-2021039064 | A1 | * | 3/2021 | F24F 7/08 |

* cited by examiner

20

20

HEAT EXCHANGER, MODULAR INDIRECT EVAPORATION COOLING SYSTEM, AND METHOD FOR CONTROLLING MODULAR INDIRECT EVAPORATION COOLING SYSTEM

CROSS-REFERENCE TO RELATED APPLICATIONS

This application claims priority to Chinese Patent Application No. 202011597241.0, filed on Dec. 28, 2020, which is hereby incorporated by reference in its entirety.

TECHNICAL FIELD

Embodiments of this application relate to the field of indirect cooling technologies, and in particular, to a heat exchanger, a modular indirect evaporation cooling system, and a method for controlling a modular indirect evaporation cooling system.

BACKGROUND

As a data center requires increasingly more energy consumption, an indirect evaporation cooling system (air handling unit, AHU) is gradually accepted by customers, and becomes a mainstream product in the future. In indirect evaporation cooling, heat in air is removed through water evaporation, to reduce a temperature on an outdoor air side. Then high-temperature air in an equipment room is cooled by using low-temperature outdoor air, to exchange heat with the high-temperature air in the equipment room through indirect evaporation.

In a conventional modular indirect evaporation cooling system (MIECS), a spray system is used to spray water on an outdoor side of a heat exchanger, to reduce a temperature of air on the outdoor side. However, when the spray system is used to spray water on the outdoor side of the heat exchanger, in a spraying process, water resources are seriously wasted, and a sprayed water flow rate is large. In addition, spraying is mainly concentrated on one face (single spray system) or two faces (double spray system) on the outdoor side. Because air continuously flows, and the water is in contact with outdoor air for a short time, heat exchange time is short, which cases low evaporation cooling efficiency of the modular indirect evaporation cooling system.

SUMMARY

Embodiments of this application provide a heat exchanger, a modular indirect evaporation cooling system, and a method for controlling a modular indirect evaporation cooling system, to improve cooling efficiency of the modular indirect evaporation cooling system.

To achieve the foregoing objectives, the following technical solutions are used in this application.

A first aspect of the embodiments of this application provides a heat exchanger, including: a first heat exchange core, including a first heat exchange fin and a first seal, where two first seals are disposed opposite to each other and are separately connected to the first heat exchange fin in an intersected manner; a second heat exchange core, including a second heat exchange fin, a second seal, and a heat exchange medium permeability channel, where two second seals are opposite to each other and are separately connected to the second heat exchange fin in an intersected manner, and the heat exchange medium permeability channel is disposed on a surface of the second heat exchange fin. The first heat exchange core and the second heat exchange core are connected in a stacked manner. A first air duct is formed in the first heat exchange core, and a second air duct is formed in the second heat exchange core. A first air inlet and a first air outlet of the first air duct are completely staggered from a second air inlet and a second air outlet of the second air duct.

According to the heat exchanger provided in this embodiment of this application, the heat exchange medium permeability channel is distributed in an entire outdoor air duct. Therefore, when outdoor air flows through the outdoor air duct, the outdoor air exchanges heat with a heat exchange medium through evaporation in an entire process. In this way, time of contact between the outdoor air and the heat exchange medium can be prolonged, to prolong time of cooling the outdoor air, thereby implementing a continuous cooling mode, and improving heat exchange efficiency. In addition, in a conventional system structure, a 36 to 48 pcs nozzle is usually used, and the nozzle is prone to be blocked. Moreover, the nozzle needs to be controlled in a spraying process, and the nozzle is at a risk of being damaged when being used for a long time. The heat exchanger in this embodiment of this application does not need a spraying nozzle, and a pump can provide the heat exchange medium to the heat exchanger immediately after being started. A cool storage technology and an indirect evaporation cooling technology are used to fully use a natural cooling source, thereby reducing system PUE (power usage effectiveness, total data center energy consumption/Internet device energy consumption) to a maximum extent. In addition, only the heat exchange medium can be separated out from the heat exchange medium permeability channel, and impurities flow away with the heat exchange medium permeability channel, so that the heat exchange medium permeability channel is at a low risk of being blocked. Moreover, in a spraying design in the conventional system structure, water is sprayed on an outdoor side of a heat exchange core by using a spraying nozzle, and a heat exchange medium flow rate is large. Consequently, heat exchange medium resources are seriously wasted in a spraying process. In addition, for a design of a dual-spray system in the conventional structure, although the dual-spray system can appropriately improve heat exchange efficiency, when an amount of exhausted air is large, a heat exchange medium on a spraying surface may be directly blown to the outdoor. As a result, this becomes invalid spraying, and heat exchange medium resources are more seriously wasted. However, in this application, the heat exchange medium flows slowly in the heat exchange medium permeability channel, and the heat exchange medium may be further recycled at an outlet of the heat exchange medium permeability channel, which greatly reduces consumption of the heat exchange medium, thereby reducing costs and improving heat exchange efficiency.

Optionally, there is a gap between the heat exchange medium permeability channel and the first heat exchange fin. In this way, an area of contact between air and the heat exchange medium permeability channel is large, so that a heat exchange area of the heat exchange medium permeability channel can be enlarged, thereby improving heat exchange efficiency.

Optionally, the first heat exchange core and the second heat exchange core are alternately connected in a stacked manner. In this way, the first air duct and the second air duct are alternately arranged, and channels on two sides of an air duct used for flowing of indoor hot air are channels used for flowing of outdoor cold air, thereby improving heat exchange efficiency of the indoor hot air.

Optionally, a shape of the first heat exchange fin is the same as a shape of the second heat exchange fin, and a projection of the second seal on the first heat exchange fin is located between the two first seals. In this way, the heat exchanger has a simple structure and a small area.

Optionally, the heat exchange medium permeability channel includes a plurality of permeability pipes arranged at intervals. In this way, a surface area of the heat exchange medium permeability channel can be enlarged, and an area of contact between air and the heat exchange medium permeability channel can be enlarged.

Optionally, the permeability pipe is located between the two first seals, and an inlet and an outlet of the permeability pipe are located at the first air inlet or the first air outlet of the first air duct. In this way, there is no need to consider sealing at a location at which the first seal is in contact with each of the inlet and outlet of the permeability pipe, thereby reducing a requirement on a sealing process. In addition, there is no need to form an opening on the first seal, thereby simplifying a structure of the first seal.

Optionally, the permeability pipe is located between the two second seals, and an inlet and an outlet of the permeability pipe are located at the second air inlet or the second air outlet of the second air duct. In this way, there is no need to consider sealing at a location at which the second seal is in contact with each of the inlet and outlet of the permeability pipe, thereby reducing a requirement on a sealing process. In addition, there is no need to form an opening on the second seal, thereby simplifying a structure of the second seal.

Optionally, the permeability pipe extends in a bending manner. The permeability pipe extending in a bending manner has a long flowing path, which can enlarge a heat exchange area, thereby improving heat exchange effect.

Optionally, a cross-sectional shape of the permeability pipe is a semicircular shape, a square shape, or a teardrop shape. The permeability pipe having a cross-sectional shape of a semicircular shape, a square shape, or a teardrop shape has a large surface area, so that an area of contact between air and the permeability pipe can be enlarged.

Optionally, the inlet and the outlet of the permeability pipe are disposed opposite to each other, and inlets of permeability pipes located on a same second heat exchange fin are located on a same side. In this way, a heat exchange medium can be provided to a plurality of permeability pipes from one side, which helps provide the heat exchange medium to the permeability pipe.

Optionally, the heat exchanger further includes a heat exchange medium supply pipe. The heat exchange medium supply pipe is connected to the inlet of the permeability pipe. The heat exchange medium is provided to a plurality of permeability pipes by using the heat exchange medium supply pipe, so that a structure is simple and easy to implement.

Optionally, the heat exchange medium supply pipe includes at least one main supply pipe and a plurality of branch supply pipes. The branch supply pipe is connected to the main supply pipe and an inlet of a permeability pipe that is located on a same second heat exchange fin as the branch supply pipe. Each second heat exchange fin corresponds to one branch supply pipe, so that a structure is simple and easy to implement.

Optionally, the at least one main supply pipe include two main supply pipes, the two main supply pipes are disposed opposite to each other on two sides of the branch supply pipe, and the branch supply pipe is connected to both of the two main supply pipes. The heat exchange medium is provided to the branch supply pipe from two ends of the branch supply pipe, to avoid an insufficient supply capability at the end of the branch supply pipe.

Optionally, the branch supply pipe is disposed on a side face of the second heat exchange fin. In this way, the branch supply pipe does not block the air inlet/outlet of the second air duct, to ensure that air smoothly flows in the second channel.

Optionally, a plurality of supply guide pipes are disposed on the branch supply pipe, the supply guide pipe is a bent pipe, and the branch supply pipe is connected to the inlet of the permeability pipe by using the supply guide pipe. The supply guide pipe is disposed on the branch supply pipe, so that when the permeability pipe and the branch supply pipe are not on a same plane, it is convenient to connect the branch supply pipe and the permeability pipe by using the supply guide pipe.

Optionally, the heat exchanger further includes a heat exchange medium return pipe. The heat exchange medium return pipe is connected to the outlet of the permeability pipe. In this way, the heat exchange medium can return for reuse, thereby reducing resource consumption.

Optionally, the heat exchange medium return pipe includes a main return pipe and a plurality of branch return pipes. The branch return pipe is connected to the main return pipe and an outlet of a permeability pipe that is located on a same second heat exchange fin as the branch return pipe. In this way, heat exchange media in a plurality of permeability pipes can be recycled from one side, which helps recycle the heat exchange medium in the permeability pipe.

Optionally, the branch return pipe is disposed on a side face of the second heat exchange fin. In this way, the branch return pipe does not block the air inlet/outlet of the second air duct, to ensure that air smoothly flows in the second channel.

Optionally, a plurality of return guide pipes are disposed on the branch return pipe, the return guide pipe is a bent pipe, and the branch return pipe is connected to the outlet of the permeability pipe by using the return guide pipe. The return guide pipe is disposed on the branch return pipe, so that when the permeability pipe and the branch return pipe are not on a same plane, it is convenient to connect the branch return pipe and the permeability pipe by using the return guide pipe.

Optionally, the heat exchanger further includes a frame. The first heat exchange core and the second heat exchange core are located in the frame. The frame can support and steady the first heat exchange core and the second heat exchange core.

Optionally, the heat exchange medium supply pipe includes a main supply pipe, and the main supply pipe is disposed on the frame. In this way, the heat exchanger can have a simple structure, and does not block the air inlets/outlets of the first air duct and the second air duct.

Optionally, the heat exchange medium return pipe includes a main return pipe, and the main return pipe is disposed on the frame. In this way, the heat exchanger can have a simple structure, and does not block the air inlets/outlets of the first air duct and the second air duct.

Optionally, the heat exchange medium permeability channel includes a semi-permeable membrane. The semi-permeable membrane is directly used to manufacture the heat exchange medium permeability channel, so that the heat exchange medium permeability channel has a simple structure, a simple process, and is easy to implement.

Optionally, a material forming the heat exchange medium permeability channel is metal or non-metal, and a through hole is disposed on the heat exchange medium permeability channel. A process of manufacturing a pipe by using metal or non-metal is mature, and has relatively low costs.

A second aspect of the embodiments of this application provides a modular indirect evaporation cooling system, including the heat exchanger according to the first aspect. Beneficial effects of the modular indirect evaporation cooling system provided in this embodiment of this application are the same as beneficial effects of the foregoing heat exchanger, and details are not described herein again.

Optionally, the modular indirect evaporation cooling system further includes a pump. A first port of the pump is connected to the main supply pipe, and a second port of the pump is connected to the main return pipe. In this way, a heat exchange medium in the main return pipe is provided to the main supply pipe after passing through the pump, so that the heat exchange medium can be recycled and reused to reduce energy consumption.

A third aspect of the embodiments of this application provides a method for controlling a modular indirect evaporation cooling system. The modular indirect evaporation cooling system includes a pump and the heat exchanger according to the first aspect. The method for controlling a modular indirect evaporation cooling system includes: controlling the pump to intermittently provide a heat exchange medium to the heat exchanger. The heat exchange medium permeability channel has a function of storing the heat exchange medium, and the pump intermittently provides the heat exchange medium to the heat exchanger, so that a quantity of consumed heat exchange media is far less than a quantity of consumed heat exchange media in a conventional spraying mode, thereby effectively reducing waste of water resources and reducing energy consumption.

DESCRIPTION OF EMBODIMENTS

The following describes technical solutions in embodiments of this application with reference to the accompanying drawings in the embodiments of this application. Apparently, the described embodiments are merely a part rather than all of the embodiments of this application.

The following terms "first", "second", and the like are merely used for ease of description, and shall not be understood as an indication or implication of relative importance or implicit indication of a quantity of indicated technical features. Therefore, a feature limited by "first", "second", or the like may explicitly or implicitly include one or more features. In description of this application, unless otherwise specified, "a plurality of" means two or more than two.

In addition, in this application, direction terms such as "top", "bottom", "left", and "right" may include but are not limited to those defined relative to schematic locations of parts shown in the accompanying drawings. It should be understood that these directional terms are relative concepts and are used for relative description and clarification, and may correspondingly change based on a change in the locations of the parts shown in the accompanying drawings.

In this application, unless otherwise explicitly specified and limited, a term "connection" should be understood in a broad sense. For example, the "connection" may be a fastened connection, a detachable connection, or an integrated connection; and may be a direct connection or an indirect connection by using an intermediate medium. In addition, the term "electrical connection" may be a direct electrical connection, or may be an indirect electrical connection by using an intermediate medium.

When an indoor temperature is relatively high, the indoor temperature needs to be lowered based on a working environment requirement, a device running environment requirement, or the like. However, different indoor environments have different cooling requires. Using a data center as an example, when direct evaporation cooling is used in an air conditioning system in the data center, a large amount of external ambient air needs to be introduced into an equipment room of the data center, which significantly increases a risk of environmental pollution and an uncontrolled humidity range in the equipment room, consequently posing a serious threat to reliable operation of a device. Therefore, an indirect evaporation cooling manner tends to be used in most data centers.

Embodiments of this application provide a modular indirect evaporation cooling system. The modular indirect evaporation cooling system includes a heat exchanger and a pump configured to provide a heat exchange medium to the heat exchanger.

A structure of the heat exchanger in the modular indirect evaporation cooling system provided in the embodiments of this application is described below.

The heat exchanger includes a first heat exchange core and a second heat exchange core.

Figure 1A:
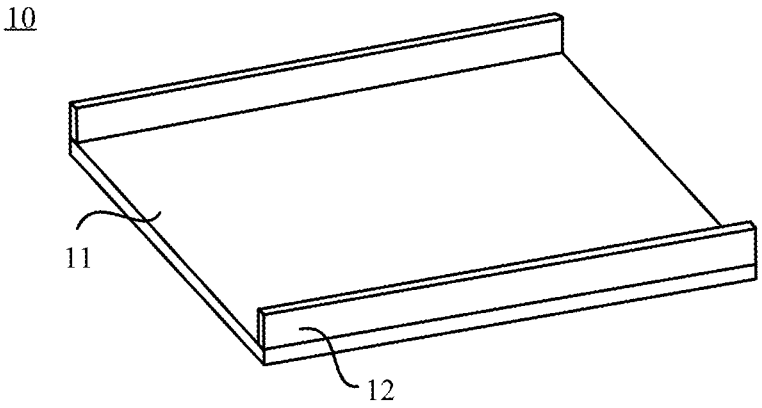
FIG. 1*a* and FIG. 1*b* are schematic diagrams of a structure of a first heat exchange core according to an embodiment of this application.
Figure 1B:
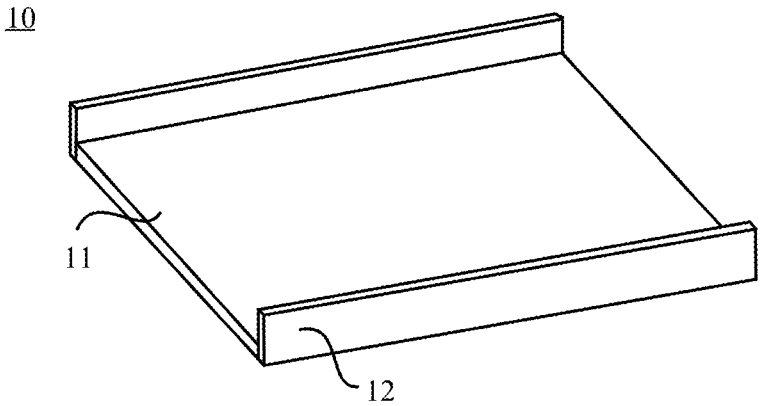

As shown in FIG. 1*a*, a first heat exchange core 10 includes a first heat exchange fin 11 and a first seal 12, and two first seals 12 are disposed opposite to each other and are separately connected to the first heat exchange fin 11 in an intersected manner.

The first heat exchange fin 11 may be a wavy fin or may be flat fin. A structure of the first heat exchange fin 11 is not limited in this embodiment of this application. A material of the first heat exchange fin 11 may be, for example, metal or a non-metal polymer material.

In addition, a shape of the first heat exchange fin 11 is not limited in this embodiment of this application. The shape of the first heat exchange fin 11 may be a rectangle (an outline of a top view is a rectangle) shown in FIG. Ta, may be a cylinder (an outline of a top view is a circle), or may be any shape (an outline of a top view is a polygon). For ease of description, that the shape of the first heat exchange fin 11 is a rectangular fin is used as an example in this embodiment of this application.

For the first seal 12, as shown in FIG. Ta, the first seal 12 may be disposed on a surface of the first heat exchange fin 11, and is connected to the surface of the first heat exchange fin 11. To fully play a function of the first heat exchange fin 11 and avoid wasting an edge region of the first heat exchange fin 11, the first seal 12 is disposed as close to an edge of the first heat exchange fin 11 as possible.

As shown in FIG. Tb, the first seal 12 may be disposed on a side face of the first heat exchange fin 11, and is connected to the side face of the first heat exchange fin 11.

As shown in FIG. 1*a* and FIG. Tb, the two first seals 12 and the first heat exchange fin 11 form a groove. Serving as walls of the groove, the two first seals 12 determine a length of the groove, thereby determining a length of an air channel. To fully play the function of the first heat exchange fin 11 and avoid wasting the edge region of the first heat exchange fin 11, the first seal 12 extends from one end to the other end of the first heat exchange fin 11. In other words, a length of a side face that is of the first heat exchange fin 11 and that is parallel to the first seal 12 is less than or equal to a length of the first seal 12.

A manner of connection between the first seal 12 and the first heat exchange fin 11 is not limited in this embodiment of this application. The first seal 12 and the first heat exchange fin 11 may be connected through crimping, fusion splicing, bonding, or the like. Certainly, the first seal 12 and the first heat exchange fin 11 may be integrally formed.

Figure 2A:
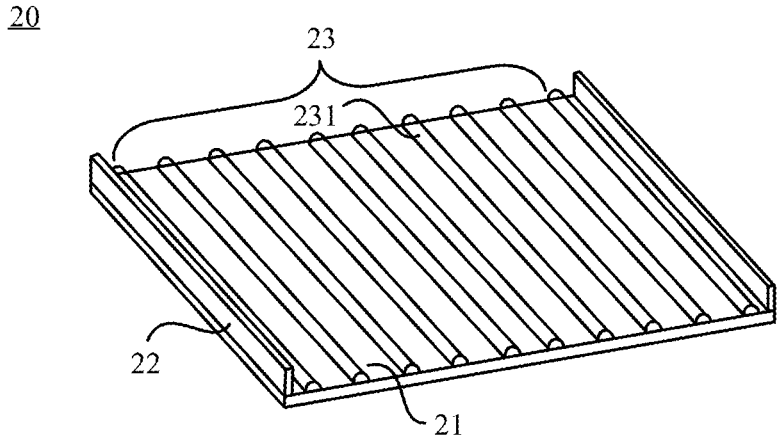
FIG. 2*a* to FIG. 2*g* are schematic diagrams of a structure of a second heat exchange core according to an embodiment of this application.

As shown in FIG. 2*a*, a second heat exchange core 20 includes a second heat exchange fin 21, a second seal 22, and a heat exchange medium permeability channel 23.

Two second seals 22 are opposite to each other and are separately connected to the second heat exchange fin 21 in an intersected manner.

The second heat exchange fin 21 may be a wavy fin or may be flat fin. A structure of the second heat exchange fin 21 is not limited in this embodiment of this application. A material of the second heat exchange fin 21 may be, for example, metal or a non-metal polymer material.

In addition, a shape of the second heat exchange fin 21 is not limited in this embodiment of this application. The shape of the second heat exchange fin 21 may be a rectangular fin (an outline of a top view is a rectangle) shown in FIG. 2*a*, may be a cylindrical fin (an outline of a top view is a circle), or may be a polygon fin of any shape (an outline of a top view is a polygon). For ease of description, that the shape of the second heat exchange fin 21 is a rectangular fin is used as an example in this embodiment of this application.

In some embodiments, a shape of the first heat exchange fin 11 is the same as a shape of the second heat exchange fin 21.

In this way, it is convenient to connect the first heat exchange fin 11 and the second heat exchange fin 21. In addition, when the first seal 12 and the second seal 22 are placed on a same heat exchange fin, the first seal 12 and the second seal 22 are disposed through splicing, thereby simplifying structures of the first seal 12 and the second seal 22.

For the second seal 22, as shown in FIG. 2*a*, the second seal 22 may be disposed on a surface of the second heat exchange fin 21, and is connected to the surface of the second heat exchange fin 21. To fully play a function of the second heat exchange fin 21 and avoid wasting an edge region of the second heat exchange fin 21, the second seal 22 is disposed as close to an edge of the second heat exchange fin 21 as possible.

Figure 2B:
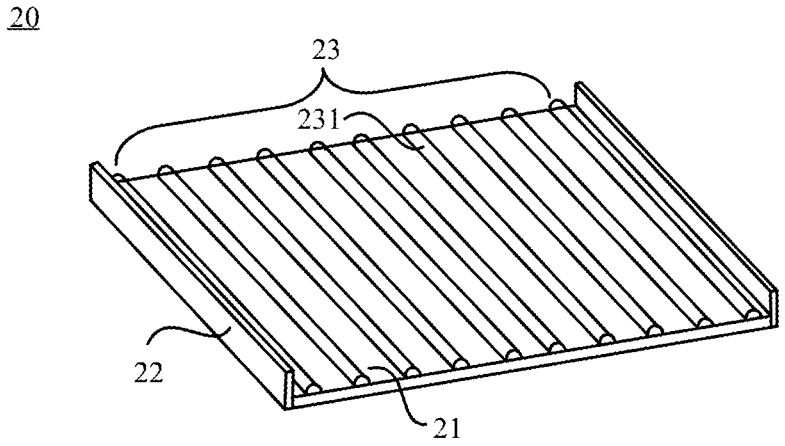

As shown in FIG. 2*b*, the second seal 22 may be disposed on a side face of the second heat exchange fin 21, and is connected to the side face of the second heat exchange fin 21.

As shown in FIG. 2*a* and FIG. 2*b*, the two second seals 22 and the second heat exchange fin 21 form a groove. Serving as walls of the groove, the two second seals 22 determine a length of the groove, thereby determining a length of an air channel. To fully play the function of the second heat exchange fin 21 and avoid wasting the edge region of the second heat exchange fin 21, the second seal 22 extends from one end to the other end of the second heat exchange fin 21. In other words, a length of a side face that is of the second heat exchange fin 21 and that is parallel to the second seal 22 is less than or equal to a length of the second seal 22.

A manner of connection between the second seal 22 and the second heat exchange fin 21 is not limited in this embodiment of this application. The second seal 22 and the second heat exchange fin 21 may be connected through crimping, fusion splicing, bonding, or the like. Certainly, the second seal 22 and the second heat exchange fin 21 may be integrally formed.

As shown in FIG. 2*a* and FIG. 2*b*, the heat exchange medium permeability channel 23 is disposed on a surface of the second heat exchange fin 21.

A structure of the heat exchange medium permeability channel 23 is not limited in this embodiment of this application, provided that a heat exchange medium located in the heat exchange medium permeability channel 23 can be slightly separated out.

In a possible embodiment, the heat exchange medium permeability channel 23 includes a semi-permeable membrane, and the heat exchange medium can be separated out through the semi-permeable membrane.

Herein, the semi-permeable membrane is directly used to manufacture the heat exchange medium permeability channel 23, so that the heat exchange medium permeability channel 23 has a simple structure, a simple process, and is easy to implement.

In another possible embodiment, a through hole is disposed on the heat exchange medium permeability channel 23, a material forming the heat exchange medium permeability channel 23 is metal or non-metal, and the heat exchange medium can be separated out through the through hole.

Herein, a process of manufacturing a pipe by using metal or non-metal is mature, and has relatively low costs.

In addition, a manner of connection between the heat exchange medium permeability channel 23 and the second heat exchange fin 21 is not limited. The heat exchange medium permeability channel 23 and the second heat exchange fin 21 may be connected through crimping, fusion splicing, bonding, or the like.

For a disposing location of the heat exchange medium permeability channel 23, in a possible embodiment, as shown in FIG. 2*a* and FIG. 2*b*, the heat exchange medium permeability channel 23 and the second seal 22 are located on a same side of the second heat exchange fin 21.

Figure 2C:
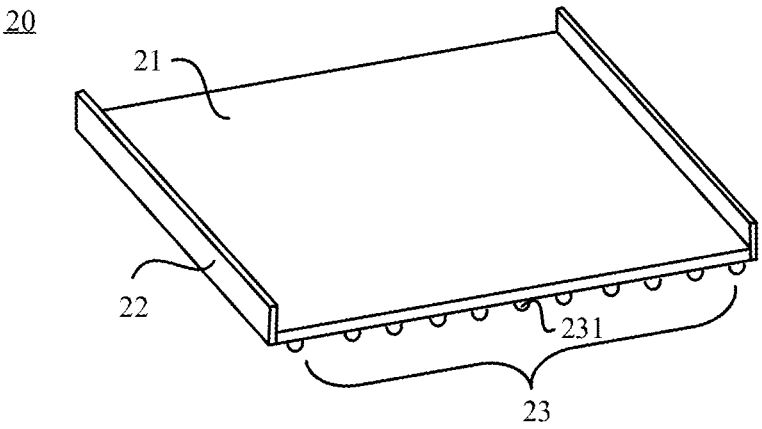

In another possible embodiment, as shown in FIG. 2*c*, the heat exchange medium permeability channel 23 and the second seal 22 are located on two opposite sides to the second heat exchange fin 21.

The structure of the heat exchange medium permeability channel 23 is described below by using an example in which the heat exchange medium permeability channel 23 and the second seal 22 are located on a same side of the second heat exchange fin 21. However, the structure of the heat exchange medium permeability channel 23 is also applicable to a structure of the heat exchange medium permeability channel 23 that is used when the heat exchange medium permeability channel 23 and the second seal 22 are disposed on two opposite sides of the second heat exchange fin 21.

Figure 2D:
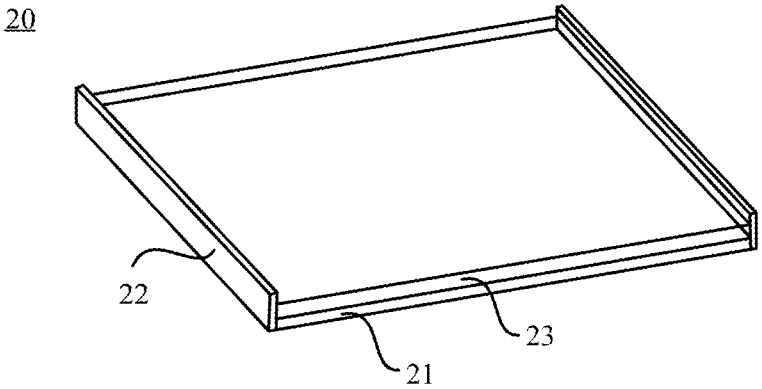

For a shape of the heat exchange medium permeability channel 23, to simplify the structure of the heat exchange medium permeability channel 23, in a possible embodiment, as shown in FIG. 2*d*, the heat exchange medium permeability channel 23 is a large channel.

To enlarge a surface area of the heat exchange medium permeability channel 23 to enlarge an area of contact between air and the heat exchange medium permeability channel 23, in another possible embodiment, as shown in FIG. 2*a* and FIG. 2*b*, the heat exchange medium permeability channel 23 includes a plurality of small channels.

For example, as shown in FIG. 2*a* to FIG. 2*c*, the heat exchange medium permeability channel 23 includes a plurality of permeability pipes 231 arranged at intervals.

The plurality of permeability pipes 231 may be arranged at equal intervals, or may be arranged at unequal intervals.

In addition, a cross-sectional shape of the permeability pipe 231 is not limited in this embodiment of this application, and the permeability pipe 231 may be a pipe of any shape.

In a possible embodiment, the cross-sectional shape of the permeability pipe 231 is a circular shape.

A circular pipe is easy to be manufactured, so that a process difficulty of the permeability pipe 231 can be reduced.

In another possible embodiment, the cross-sectional shape of the permeability pipe 231 is a semicircular shape, a square shape, or a teardrop shape.

In FIG. 2*a* to FIG. 2*c*, that the cross-sectional shape of the permeability pipe is a semicircular shape is used as an example for illustration.

The permeability pipe 231 having a cross-sectional shape of a semicircular shape, a square shape, or a teardrop shape has a large surface area, so that an area of contact between air and the permeability pipe 231 can be enlarged.

For an extension trajectory of the permeability pipe 231, in a possible embodiment, as shown in FIG. 2*a* and FIG. 2*b*, the permeability pipe 231 extends linearly.

The linearly extended permeability pipe 231 has a simple structure and a low process difficulty.

Figure 2E:
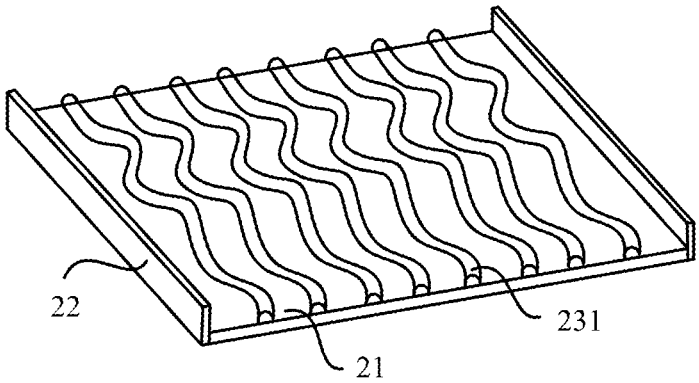
Figure 2F:
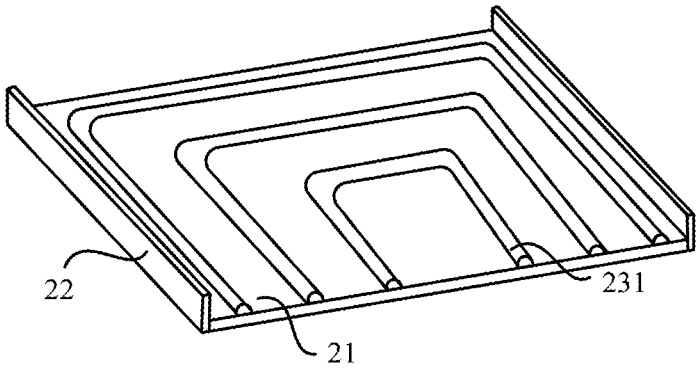

In another possible embodiment, as shown in FIG. 2*e* and FIG. 2*f*, the permeability pipe 231 extends in a bending manner.

The permeability pipe 231 extending in a bending manner has a long flowing path, which can enlarge a heat exchange area, thereby improving heat exchange effect.

Based on the extension trajectory of the permeability pipe 231, in a possible embodiment, as shown in FIG. 2*a*, an inlet and an outlet of the permeability pipe 231 are located on two opposite sides. In another possible embodiment, as shown in FIG. 2*f*, the inlet and the outlet of the permeability pipe 231 are located on a same side.

Figure 2G:
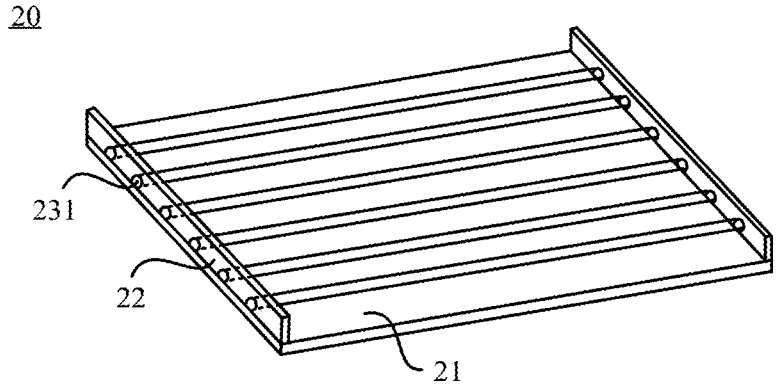

For locations of the inlet and the outlet of the permeability pipe 231, in a possible embodiment, as shown in FIG. 2*g*, at least one of the inlet and the outlet of the permeability pipe 231 is located on a side on which the second seal 22 is located. In FIG. 2*g*, that both the inlet and the outlet of the permeability pipe 231 are located on the side on which the second seal 22 is located is used as an example for illustration.

It can be understood that in this case, an opening corresponding to each of the inlet and the outlet of the permeability pipe 231 is disposed on the second seal 22.

In another possible embodiment, as shown in FIG. 2*a* and FIG. 2*f*, at least one of the inlet and the outlet of the permeability pipe 231 is located on a side that is of the second heat exchange fin 21 and on which the second seal 22 is not disposed.

In FIG. 2*a* and FIG. 2*f*, that both the inlet and the outlet of the permeability pipe 231 are located on the side on which the second seal 22 is not disposed is used as an example for illustration.

In this way, there is no need to consider sealing at a location at which the second seal 22 is in contact with each of the inlet and outlet of the permeability pipe 231, thereby reducing a requirement on a sealing process. In addition, there is no need to form an opening on the second seal 22, thereby simplifying a structure of the second seal 22.

Regardless of a specific structure in the foregoing structures that is used for the permeability pipe 231, to reduce a process difficulty and help provide and recycle a heat exchange medium, in some embodiments, inlets of permeability pipes 231 located on a same second heat exchange fin 21 are located on a same side, and outlets of the permeability pipes 231 located on the same second heat exchange fin 21 are located on a same side.

In some embodiments, the inlet and the outlet of the permeability pipe 231 are located on different sides. For example, as shown in FIG. 2*a*, the inlet and the outlet of the permeability pipe 231 are disposed opposite to each other.

In this way, the inlet of the permeability pipe 231 only provides the heat exchange medium, and the outlet of the permeability pipe 231 only recycles the heat exchange medium, which is easy to perform operation.

In some embodiments, as shown in FIG. 2*a* to FIG. 2*g*, the inlet or the outlet of the permeability pipe 231 is located at an end of the second heat exchange fin 21.

In this way, a flowing path of the permeability pipe 231 can be prolonged, to prolong time of contact between wind and the permeability pipe 231, thereby improving heat exchange efficiency.

Figure 3A:
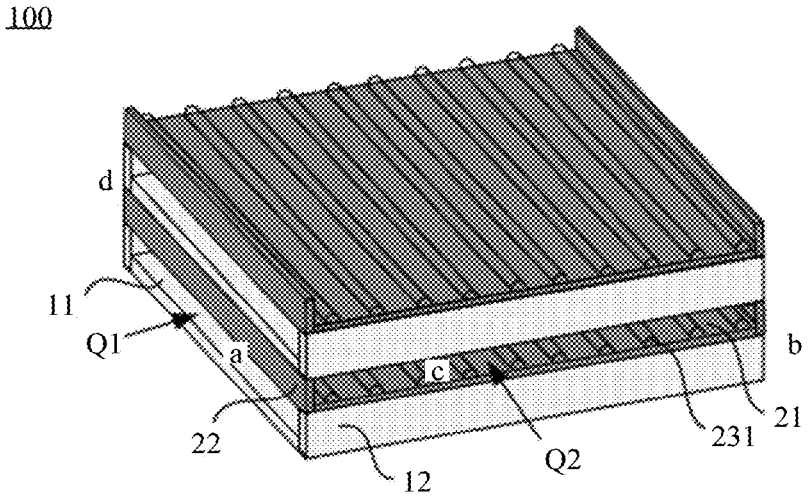
FIG. 3*a* and FIG. 3*b* are schematic diagrams of a structure of a heat exchanger according to an embodiment of this application.

As shown in FIG. 3*a*, the first heat exchange core 10 and the second heat exchange core 20 included in a heat exchanger 100 are connected in a stacked manner, a first air duct Q1 is formed in the first heat exchange core 10, and a second air duct Q2 is formed in the second heat exchange core 20.

The first seal 12 is connected to the second heat exchange fin 21, to connect the first heat exchange core 10 and the second heat exchange core 20. The second seal 22 is connected to the first heat exchange fin 11, to connect the second heat exchange core 20 and the first heat exchange core 10.

For example, the first seal 12 and the second heat exchange fin 21 may be connected through crimping, fusion splicing, bonding, or welding. Similarly, for example, the second seal 22 and the first heat exchange fin 11 may be connected through crimping, fusion splicing, bonding, or welding.

For example, in a possible embodiment, the first heat exchange core 10 and the second heat exchange core 20 are regularly connected in a stacked manner with first one layer of first heat exchange core 10 and then a plurality of layers of second heat exchange core.

In other words, the first air duct Q1 and the second air duct Q2 are stacked regularly with one first air duct Q1 and then a plurality of second air ducts Q2.

For example, in another possible embodiment, the first heat exchange core 10 and the second heat exchange core 20 are regularly connected in a stacked manner with first a plurality of layers of first heat exchange core 10 and then one layer of second heat exchange core 20.

In other words, the first air duct Q1 and the second air duct Q2 are stacked regularly with first a plurality of first air ducts Q1 and then one second air duct Q2.

In another possible embodiment, there is no rule for stacking the first heat exchange core 10 and the second heat exchange core 20, provided that the first heat exchange core 10 and the second heat exchange core 20 are connected in a stacked manner.

In another possible embodiment, the first heat exchange core 10 and the second heat exchange core 20 are alternately connected in a stacked manner. To be specific, the first heat exchange core 10 and the second heat exchange core 20 are regularly connected in a stacked manner with first one layer of first heat exchange core 10 and then one layer of second heat exchange core 20.

In other words, the first air duct Q1 and the second air duct Q2 are stacked regularly with first one first air duct Q1 and then one second air duct Q2.

Based on this, as shown in FIG. 3*a*, the first seal 12, the first heat exchange fin 11, and the second heat exchange fin 21 form the first air duct Q1. The second seal 22, the second heat exchange fin 21, and the first heat exchange fin 11 form the second air duct Q2.

In this way, the first air duct Q1 and the second air duct Q2 are alternately arranged, and channels on two sides of an air duct used for flowing of indoor hot air are channels used for flowing of outdoor cold air, thereby improving heat exchange efficiency of the indoor hot air.

To implement that wind in the first air duct Q1 is completely out of contact with wind in the second air duct Q2, as shown in FIG. 3*a*, a first air inlet a and a first air outlet b of the first air duct Q1 are completely staggered from a second air inlet c and a second air outlet d of the second air duct Q2.

That the first heat exchange fin 11 and the second heat exchange fin 21 are in a shape of a rectangle is used as an example. The first air inlet a, the first air outlet b, the second air inlet c, and the second air outlet d are located on four sides of the rectangle.

It can be understood that the first air duct Q1 and the second air duct Q2 are an indoor air duct and an outdoor air duct of each other.

As shown in FIG. 3*a*, in a possible embodiment, the permeability pipe 231 is located between the two second seals 22.

In this case, the second air duct Q2 is an outdoor air duct, and the first air duct Q1 is an indoor air duct. A structure of the second heat exchange core 20 may be shown in FIG. 2*a* or FIG. 2*g*.

In a possible embodiment, the inlet and the outlet of the permeability pipe 231 are located on the second seal 22, and an opening is disposed on the second seal 22.

In another possible embodiment, as shown in FIG. 3*a*, to facilitate manufacturing of the permeability pipe 231 and avoid disposing an opening on the second seal 22, the inlet and the outlet of the permeability pipe 231 are located at the second air inlet c or the second air outlet d of the second air duct Q2.

Optionally, as shown in FIG. 3*a*, the inlet of the permeability pipe 231 is located at the second air inlet c of the second air duct Q2, and the outlet of the permeability pipe 231 is located at the second air outlet d of the second air duct Q2.

Optionally, the outlet of the permeability pipe 231 is located at the second air inlet c of the second air duct Q2, and the inlet of the permeability pipe 231 is located at the second air outlet d of the second air duct Q2.

Optionally, both the inlet and the outlet of the permeability pipe 231 are located at the second air inlet c of the second air duct Q2.

Optionally, both the inlet and the outlet of the permeability pipe 231 are located at the second air outlet d of the second air duct Q2.

Figure 3B:
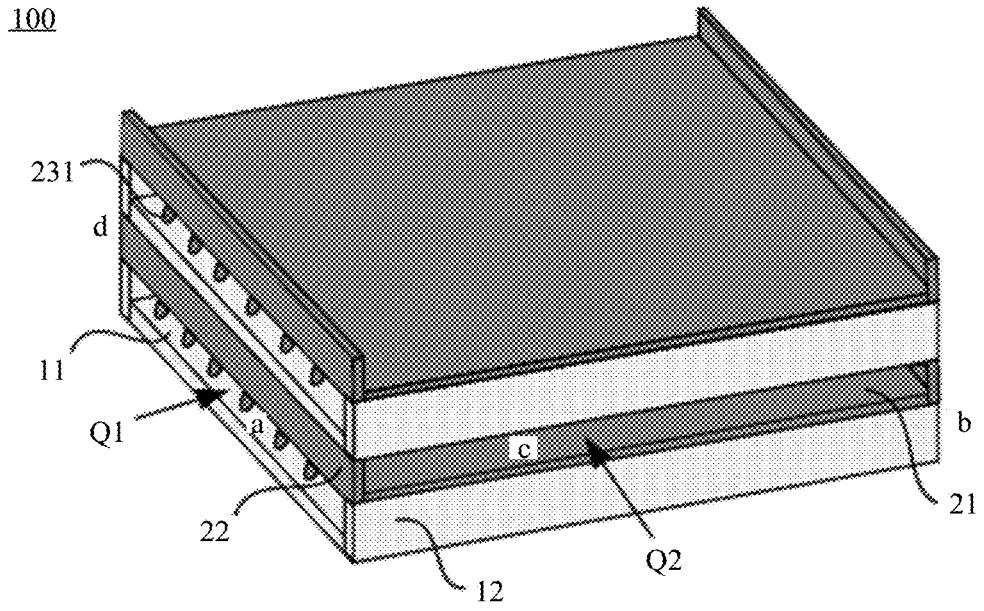

As shown in FIG. 3*b*, in another possible embodiment, the permeability pipe 231 is located between the two first seals 12.

In this case, the first air duct Q1 is an outdoor air duct, and the second air duct Q2 is an indoor air duct. A structure of the second heat exchange core 20 may be shown in FIG. 2*c* or FIG. 3*b*.

In a possible embodiment, the structure of the second heat exchange core 20 is shown in FIG. 2*c*. In this case, the inlet and the outlet of the permeability pipe 231 are located on the first seal 12, and an opening is disposed on the first seal 12.

In another possible embodiment, as shown in FIG. 3*b*, to facilitate manufacturing of the permeability pipe 231 and avoid disposing an opening on the first seal 12, the inlet and the outlet of the permeability pipe 231 are located at the first air inlet a or the first air outlet b of the first air duct Q1.

Optionally, as shown in FIG. 3*b*, the inlet of the permeability pipe 231 is located at the first air inlet a of the first air duct Q1, and the outlet of the permeability pipe 231 is located at the first air outlet b of the first air duct Q1.

Optionally, the outlet of the permeability pipe 231 is located at the first air inlet a of the first air duct Q1, and the inlet of the permeability pipe 231 is located at the first air outlet b of the first air duct Q1.

Optionally, both the inlet and the outlet of the permeability pipe 231 are located at the first air inlet a of the first air duct Q1.

Optionally, both the inlet and the outlet of the permeability pipe 231 are located at the first air outlet b of the first air duct Q1.

In conclusion, as shown in FIG. 3*a* and FIG. 3*b*, an air duct having the permeability pipe 231 is an outdoor air duct, and an air duct without the permeability pipe 231 is an indoor air duct.

Based on this, there is a gap between the heat exchange medium permeability channel 23 and the first heat exchange fin 11.

As shown in FIG. 3*a* and FIG. 3*b*, there is a gap between the permeability pipe 231 and the first heat exchange fin 11.

In this way, an area of contact between air and the heat exchange medium permeability channel 23 is large, so that a heat exchange area of the heat exchange medium permeability channel 23 can be enlarged, thereby improving heat exchange efficiency.

Figure 3C:
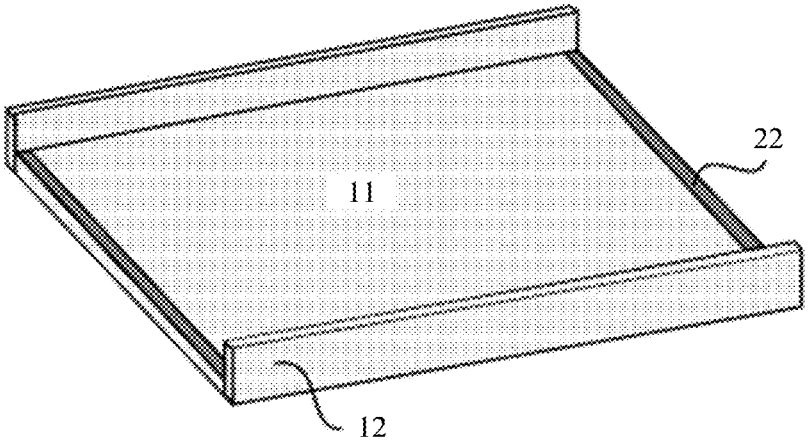
FIG. 3*c* is a diagram of a projection of a second seal on a first heat exchange fin according to an embodiment of this application.

In addition, as shown in FIG. 3*c*, a shape of the first heat exchange fin 11 is the same as a shape of the second heat exchange fin 21, and a projection of the second seal 22 on the first heat exchange fin 11 is located between the two first seals 12.

In this way, locations of the second air duct Q2 that correspond to the first air inlet a and the first air outlet b of the first air duct Q1 (that is, corresponding to a gap between the two first seals 12) are blocked by the second seal 22, so that wind passing the first air inlet a and the first air outlet b of the first air duct Q1 does not enter the second air duct Q2.

Figure 3D:
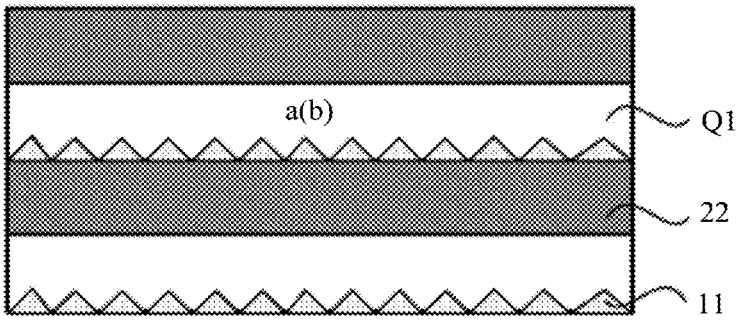
FIG. 3*d* shows a side view on a side on which a first air inlet or a first air outlet of a heat exchanger is located according to an embodiment of this application.

To be specific, as shown in FIG. 3*d*, as seen from a side view, an upper side and a lower side of each of the first air inlet a and the first air outlet b of the first air duct Q1 are the second seals 22. In FIG. 3*d*, that the first heat exchange fin 11 is a wavy fin is used as an example for illustration.

Similarly, a projection of the first seal 12 on the second heat exchange fin 21 is located between the two second seals 22.

In this way, locations of the first air duct Q1 that correspond to the second air inlet c and the second air outlet d of the second air duct Q2 (that is, corresponding to a gap between the two second seals 22) are blocked by the first seal 12, so that wind passing the second air inlet c and the second air outlet d of the second air duct Q2 does not enter the first air duct Q1.

Figure 3E:
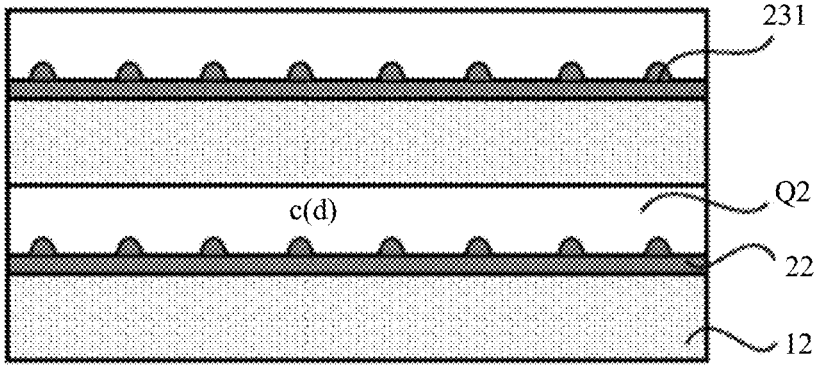
FIG. 3*e* shows a side view on a side on which a second air inlet or a second air outlet of a heat exchanger is located according to an embodiment of this application.

To be specific, as shown in FIG. 3*e*, as seen from a side view, an upper side and a lower side of each of second air inlet c and the second air outlet d of the second air duct Q2 are the first seals 12. In FIG. 3*e*, that the second heat exchange fin 21 is a flat fin is used as an example for illustration.

For ease of description, in this embodiment of this application, that the second air duct Q2 shown in FIG. 3*a* is an outdoor air duct, and the first air duct Q1 shown in FIG. 3*a* is an indoor air duct is used as an example to describe a heat exchange principle of the heat exchanger 100 provided in this embodiment of this application.

Outdoor air enters from the second air inlet c of the second air duct Q2, and when passing through the second air duct Q2, the outdoor air flows on an outer surface of the heat exchange medium permeability channel 23. A heat exchange medium (for example, water) is separated out from the heat exchange medium permeability channel 23 to the outer surface. The heat exchange medium on the outer surface of the heat exchange medium permeability channel 23 needs to absorb heat to evaporate, to exchange heat with the outdoor air through evaporation, so as to remove heat from outdoor air, thereby lowering a temperature of the outdoor air. When passing through the first air duct Q1, indoor air exchanges heat with the outdoor air in the second air duct Q2 by using a temperature difference between the indoor air and the outdoor air and by using the first heat exchange fin 11 or the second heat exchange fin 21 located on a boundary area between the first air duct Q1 and the second air duct Q2, to lower a temperature of the indoor air.

According to the heat exchanger 100 provided in this embodiment of this application, the heat exchange medium permeability channel 23 is distributed in an entire outdoor air duct. Therefore, when outdoor air flows through the outdoor air duct, the outdoor air exchanges heat with a heat exchange medium through evaporation in an entire process. In this way, time of contact between the outdoor air and the heat exchange medium can be prolonged, to prolong time of cooling the outdoor air, thereby implementing a continuous cooling mode, and improving heat exchange efficiency.

In addition, in a conventional system structure, a 36 to 48 pcs nozzle is usually used, and the nozzle is prone to be blocked. Moreover, the nozzle needs to be controlled in a spraying process, and the nozzle is at a risk of being damaged when being used for a long time. The heat exchanger 100 in this embodiment of this application does not need a spraying nozzle, and a pump can provide the heat exchange medium to the heat exchanger 100 immediately after being started. A cool storage technology and an indirect evaporation cooling technology are used to fully use a natural cooling source, thereby reducing system PUE (power usage effectiveness, total data center energy consumption/Internet device energy consumption) to a maximum extent. In addition, only the heat exchange medium can be separated out from the heat exchange medium permeability channel 23, and impurities flow away with the heat exchange medium permeability channel 23, so that the heat exchange medium permeability channel 23 is at a low risk of being blocked.

Moreover, in a spraying design in the conventional system structure, water is sprayed on an outdoor side of a heat exchange core by using a spraying nozzle, and a heat exchange medium flow rate is large. Consequently, heat exchange medium resources are seriously wasted in a spraying process. In addition, for a design of a dual-spray system in the conventional structure, although the dual-spray system can appropriately improve heat exchange efficiency, when an amount of exhausted air is large, a heat exchange medium on a spraying surface may be directly blown to the outdoor. As a result, this becomes invalid spraying, and heat exchange medium resources are more seriously wasted. However, in this application, the heat exchange medium flows slowly in the heat exchange medium permeability channel 23, and the heat exchange medium may be further recycled at an outlet of the heat exchange medium permeability channel 23, which greatly reduces consumption of the heat exchange medium, thereby reducing costs and improving heat exchange efficiency.

Based on the foregoing structure, the heat exchanger 100 further includes a heat exchange medium supply pipe, and the heat exchange medium supply pipe is connected to an inlet of the heat exchange medium permeability channel 23 (for example, the permeability pipe 231), and is configured to transmit a heat exchange medium to the heat exchange medium permeability channel 23.

Figure 4A:
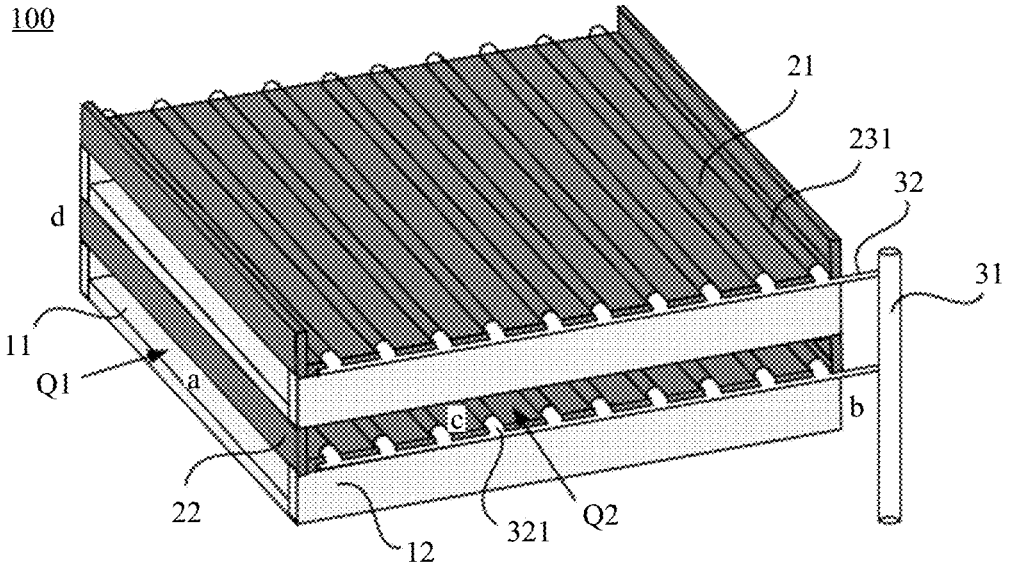
FIG. 4*a* to FIG. 4*c* are schematic diagrams of a structure of another heat exchanger according to an embodiment of this application.

For a structure of the heat exchange medium supply pipe, in a possible embodiment, as shown in FIG. 4*a*, the heat exchange medium supply pipe includes one main supply pipe 31 and a plurality of branch supply pipes 32. Each branch supply pipe 32 is connected to the main supply pipe 31 and an inlet of a permeability pipe 231 that is located on a same second heat exchange fin 21 as the branch supply pipe 32.

In other words, the inlet of each permeability pipe 231 is connected to one branch supply pipe 32.

Figure 4B:
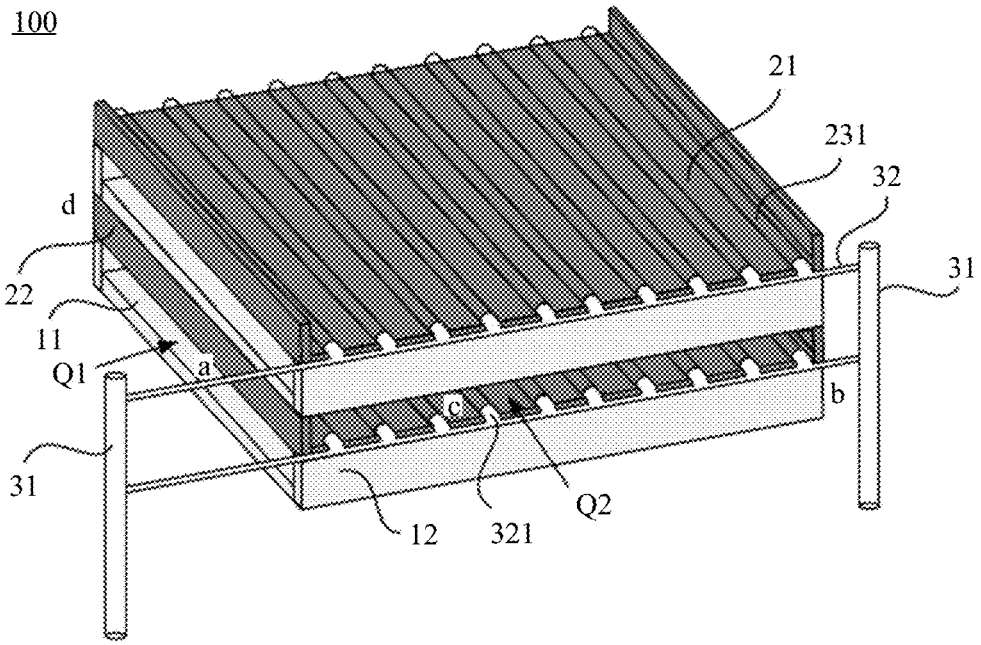
Figure 4C:
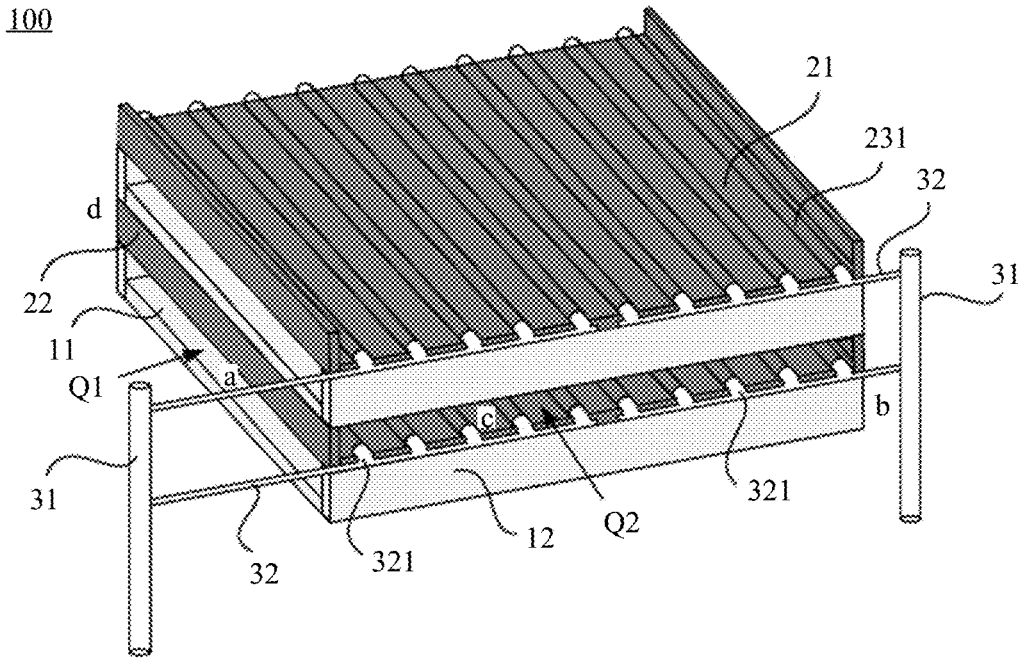

In another possible embodiment, as shown in FIG. 4*b* and FIG. 4*c*, the heat exchange medium supply pipe includes a plurality of main supply pipes 31 and a plurality of branch supply pipes 32. Each branch supply pipe 32 is connected to at least one main supply pipe 31 and an inlet of a permeability pipe 231 that is located on a same second heat exchange fin 21 as the branch supply pipe 32.

The plurality of main supply pipes 31 provide heat exchange media to the plurality of branch supply pipes 32, so that each branch supply pipe 32 can receive plenty of heat exchange media.

Figure 5A:
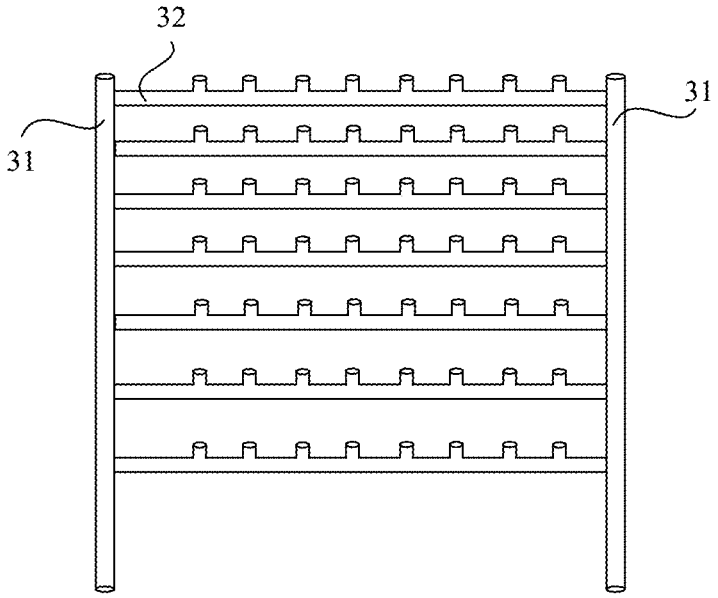
FIG. 5*a* to FIG. 5*c* are schematic diagrams of a structure of a heat exchange medium supply pipe according to an embodiment of this application.

Optionally, as shown in FIG. 4*b* and FIG. 5*a*, the heat exchange medium supply pipe includes two main supply pipes 31. The two main supply pipes 31 are disposed opposite to each other on two sides of the branch supply pipe 32, and the branch supply pipe 32 is connected to both of the two main supply pipes 31.

The heat exchange medium is provided to the branch supply pipe 32 from two ends of the branch supply pipe 32, to avoid an insufficient supply capability at the end of the branch supply pipe 32.

Figure 5B:
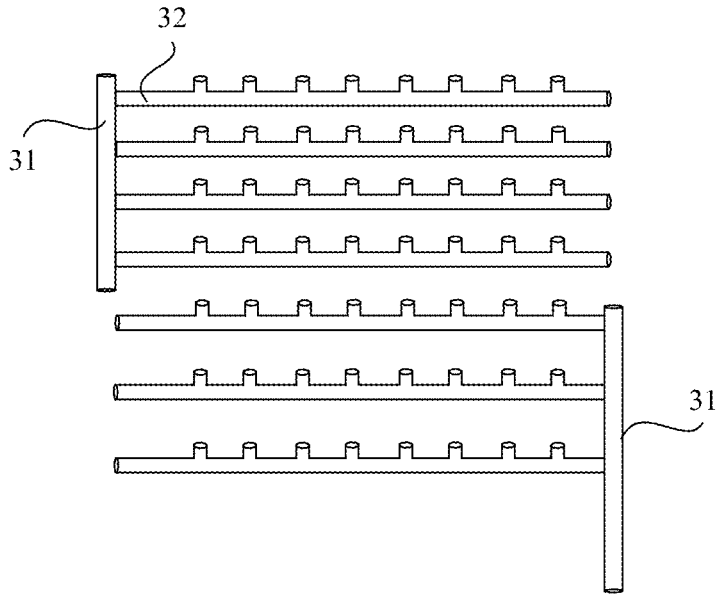
Figure 5C:
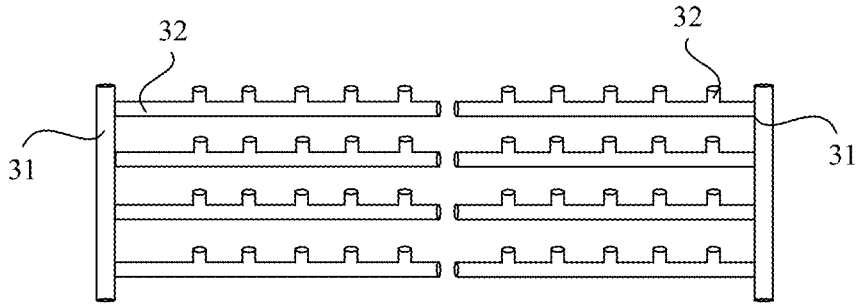

Optionally, as shown in FIG. 4*c*, FIG. 5*b*, and FIG. 5*c*, the heat exchange medium supply pipe includes a plurality of main supply pipes 31 (two main supply pipes 31 are used as an example in FIG. 5*b*), each main supply pipe 31 is connected to some of a plurality of branch supply pipes 32, and each branch supply pipe 32 is connected to at least one main supply pipe 31.

For the branch supply pipe 32, in a possible embodiment, as shown in FIG. 4*a* and FIG. 4*b*, inlets of permeability pipes 231 located on a same second heat exchange fin 21 is connected to a same branch supply pipe 32.

Considering that the supply capability at the end of the branch supply pipe 32 may be insufficient, in another possible embodiment, as shown in FIG. 4*c*, some of permeability pipes 231 located on a same second heat exchange fin 21 is connected to a same branch supply pipe 32, and each permeability pipe 231 is connected to one branch supply pipe 32.

For a disposing location of the branch supply pipe 32, in a possible embodiment, as shown in FIG. 4*a* to FIG. 4*c*, the branch supply pipe 32 is disposed on a side face of the second heat exchange fin 21.

It can be understood that to shorten a length of the branch supply pipe 32, the branch supply pipe 32 and the inlet of the permeability pipe 231 are located at a same end of the second heat exchange fin 21.

In this way, the branch supply pipe 32 does not block the air inlet/outlet of the second air duct Q2, to ensure that air smoothly flows in the second channel Q2.

Based on this, as shown in FIG. 4*a* to FIG. 4*c*, a plurality of supply guide pipes 321 are disposed on the branch supply pipe 32, the supply guide pipe 321 is a bent pipe, and the branch supply pipe 32 is connected to the inlet of the permeability pipe 231 by using the supply guide pipe 321.

A material of the supply guide pipe 321 is not limited. For example, the material of the supply guide pipe 321 may be a flexible material, and the supply guide pipe 321 may be bent based on a requirement. Alternatively, the material of the supply guide pipe 321 is a rigid material, and during manufacturing, the supply guide pipe 321 is directly manufactured to a required bent shape.

The supply guide pipe 321 and the branch supply pipe 32 may be in an integral structure, or may be connected through fusion splicing, bonding, welding, or the like.

In addition, one permeability pipe 231 may be connected to only one supply guide pipe 321, or one permeability pipe 231 may be connected to a plurality of supply guide pipes 321. In this embodiment of this application, only that one permeability pipe 231 is connected to one supply guide pipe 321 is used as an example for illustration.

The supply guide pipe 321 is disposed on the branch supply pipe 32, so that when the permeability pipe 231 and the branch supply pipe 32 are not on a same plane, it is convenient to connect the branch supply pipe 32 and the permeability pipe 231 by using the supply guide pipe 321.

None of cross-sectional shapes of the main supply pipe 31, the branch supply pipe 32, and the supply guide pipe 321 is limited above. The cross-sectional shapes of the main supply pipe 31, the branch supply pipe 32, and the supply guide pipe 321 each may be a circular shape, an oval shape, or another shape.

Similarly, for the outlet of the heat exchange medium permeability channel 23, in some embodiments, the heat exchanger 100 further includes a heat exchange medium return pipe. The heat exchange medium return pipe is connected to the outlet of the heat exchange medium permeability channel 23 (for example, the permeability pipe 231).

A structure and a disposing location of the heat exchange medium return pipe may be the same as a structure and a disposing location of the heat exchange medium supply pipe, but the heat exchange medium supply pipe is connected to the inlet of the heat exchange medium permeability channel 23, and the heat exchange medium return pipe is connected to the outlet of the heat exchange medium permeability channel 23.

For example, in some embodiments, the heat exchange medium return pipe includes a main return pipe and a plurality of branch return pipes. The branch return pipe is connected to the main return pipe and an outlet of a permeability pipe that is located on a same second heat exchange fin as the branch return pipe.

To avoid blocking the air inlet/outlet of the second air duct Q2, in some embodiments, the branch return pipe is disposed on a side face of the second heat exchange fin 21.

To facilitate connection between the branch return pipe and the permeability pipe, in some embodiments, a plurality of return guide pipes are disposed on the branch return pipe, the return guide pipe is a bent pipe, and the branch return pipe is connected to the outlet of the permeability pipe 231 by using the return guide pipe.

For the main return pipe, refer to the related description of the main supply pipe. For the branch return pipe, refer to the related description of the branch supply pipe. For the return guide pipe, refer to the related description of the supply guide pipe. Details are not described herein again. Based on the foregoing structure, the heat exchanger 100 further includes a frame. The first heat exchange core 10 and the second heat exchange core 20 are located in the frame.

In other words, the frame steadies, supports, and carries the first heat exchange core 10 and the second heat exchange core 20.

Certainly, it can be understood that the frame does not block air inlets/outlets of the first air duct Q1 and the second air duct Q2.

In some embodiments, the main supply pipe 31 of the heat exchange medium supply pipe is disposed on the frame.

In some embodiments, the main return pipe of the heat exchange medium return pipe is disposed on the frame.

In this way, the heat exchanger 100 can have a simple structure, and does not block the air inlets/outlets of the first air duct Q1 and the second air duct Q2.

Based on the foregoing heat exchanger 100, the pump in the modular indirect evaporation cooling system is connected to the main supply pipe 31, and is configured to provide a heat exchange medium to the main supply pipe 31.

Figure 6A:
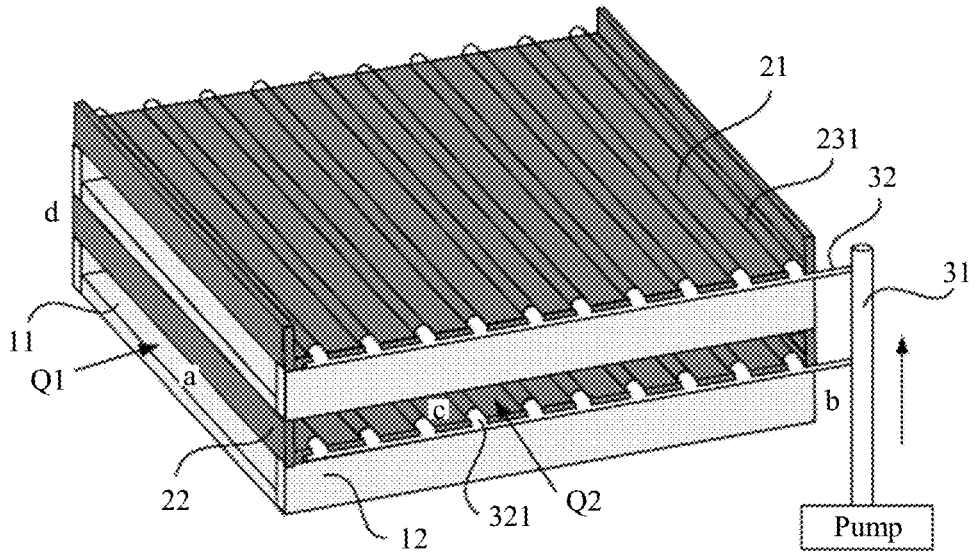
FIG. 6*a* and FIG. 6*b* are schematic diagrams of a structure of a modular indirect evaporation cooling system according to an embodiment of this application.
Figure 6B:
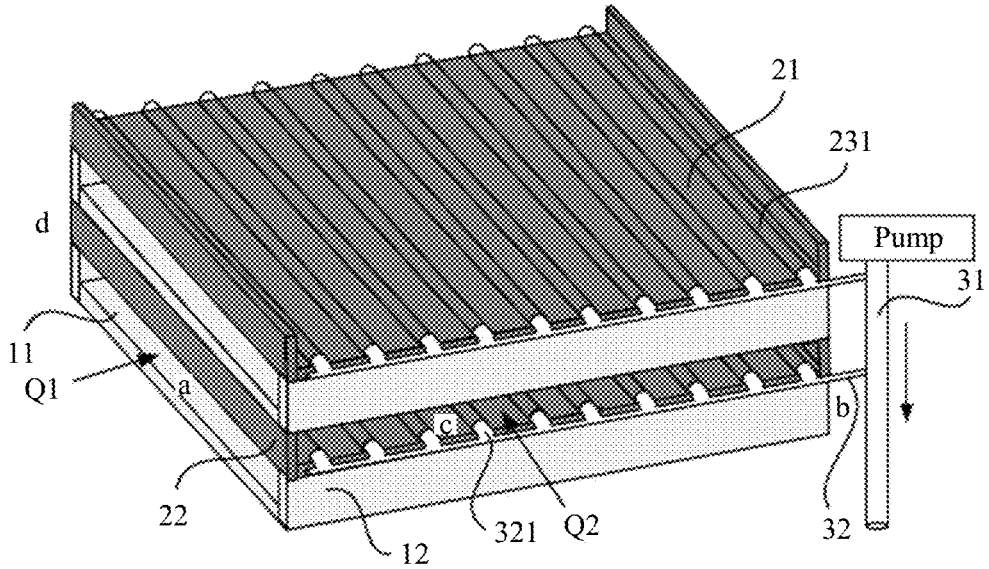

As shown in FIG. 6*a*, the pump may be located at a lower end of the main supply pipe 31, and a provided medium flows from bottom to top in an arrow direction in the main supply pipe 31. As shown in FIG. 6*b*, the pump may be located at an upper end of the main supply pipe 31, and a provided medium flows from top to bottom in an arrow direction in the main supply pipe 31.

In some embodiments, a first port of the pump is connected to the main supply pipe 31, and a second port of the pump is connected to the main return pipe.

In this way, a heat exchange medium in the main return pipe is provided to the main supply pipe 31 after passing through the pump, so that the heat exchange medium can be recycled and reused to reduce energy consumption.

The heat exchange medium permeability channel 23 has a function of storing the heat exchange medium. Therefore, to further reduce power consumption, when the modular indirect evaporation cooling system in the embodiments of this application is controlled, the pump is controlled to intermittently provide the heat exchange medium to the heat exchanger 100.

For example, the pump is controlled to be started for m seconds, and suspended for n seconds, to circularly provide the heat exchange medium to the heat exchanger 100. The pump intermittently provides the heat exchange medium to the heat exchanger 100, and a quantity of consumed heat exchange media is far less than a quantity of consumed heat exchange media in a conventional spraying mode, thereby effectively reducing waste of water resources and reducing energy consumption.

The foregoing description is merely specific implementations of this application, but are not intended to limit the protection scope of this application. Any variation or replacement within the technical scope disclosed in this application shall fall within the protection scope of this application. Therefore, the protection scope of this application shall be subject to the protection scope of the claims.

What is claimed is:

1. A heat exchanger comprising:

a first heat exchange core, comprising a first heat exchange fin and a first seal, wherein two first seals are disposed opposite to each other and are separately connected to the first heat exchange fin in an intersected manner; and a second heat exchange core, comprising a second heat exchange fin, a second seal, and a heat exchange medium permeability channel, wherein two second seals are opposite to each other and are separately connected to the second heat exchange fin in an intersected manner, and the heat exchange medium permeability channel is disposed on a surface of the second heat exchange fin, wherein the first heat exchange core and the second heat exchange core are connected in a stacked manner, a first air duct is formed in the first heat exchange core, and a second air duct is formed in the second heat exchange core;

a first air inlet and a first air outlet of the first air duct are completely staggered from a second air inlet and a second air outlet of the second air duct, wherein the heat exchange medium permeability channel comprises a plurality of permeability pipes arranged at intervals; and a heat exchange medium supply pipe connected to an inlet of the permeability pipes.

2. The heat exchanger according to claim 1, wherein there is a gap between the heat exchange medium permeability channel and the first heat exchange fin.

3. The heat exchanger according to claim 1, wherein the first heat exchange core and the second heat exchange core are alternately connected in a stacked manner.

4. The heat exchanger according to claim 1, wherein a shape of the first heat exchange fin is the same as a shape of the second heat exchange fin, and a projection of the second seal on the first heat exchange fin is located between the two first seals.

5. The heat exchanger according to claim 1, wherein the permeability pipes are located between the two first seals, and the inlet and an outlet of the permeability pipes are located at the first air inlet or the first air outlet of the first air duct.

6. The heat exchanger according to claim 1, wherein the permeability pipes are located between the two second seals, and the inlet and an outlet of the permeability pipes are located at the second air inlet or the second air outlet of the second air duct.

7. The heat exchanger according to claim 1, wherein at least one of the permeability pipes extend in a bending manner.

8. The heat exchanger according to claim 1, wherein a cross-sectional shape of the permeability pipes are a semi-circular shape, a square shape, or a teardrop shape.

9. The heat exchanger according to claim 6, wherein the inlet and the outlet of the permeability pipes are disposed opposite to each other, and inlets of permeability pipes located on a same second heat exchange fin are located on a same side.

10. The heat exchanger according to claim 1, wherein the heat exchange medium supply pipes comprise at least one main supply pipe and a plurality of branch supply pipes; and the branch supply pipe is connected to the main supply pipe and an inlet of a permeability pipe that is located on a same second heat exchange fin as the branch supply pipe.

11. The heat exchanger according to claim 10, wherein the at least one main supply pipe includes two main supply pipes, which are disposed opposite to each other on two sides of the branch supply pipe, and the branch supply pipe is connected to both of the two main supply pipes.

12. The heat exchanger according to claim 10, wherein the branch supply pipe is disposed on a side face of the second heat exchange fin.

13. The heat exchanger according to claim 12, wherein a plurality of supply guide pipes are disposed on the branch supply pipe, the supply guide pipe is a bent pipe, and the branch supply pipe is connected to the inlet of the permeability pipes by using the supply guide pipe.

14. The heat exchanger according to claim 6, wherein the heat exchanger further comprises a heat exchange medium return pipe, which is connected to the outlet of the permeability pipes.

15. The heat exchanger according to claim 14, wherein the heat exchange medium return pipe comprises a main return pipe and a plurality of branch return pipes; and the branch return pipe is connected to the main return pipe and an outlet of a permeability pipes that is located on a same second heat exchange fin as the branch return pipe.

16. The heat exchanger according to claim 15, wherein the branch return pipe is disposed on a side face of the second heat exchange fin.

17. A modular indirect evaporation cooling system, comprising a heat exchanger, which comprises:

a first heat exchange core, comprising a first heat exchange fin and a first seal, wherein two first seals are disposed opposite to each other and are separately connected to the first heat exchange fin in an intersected manner; and a second heat exchange core, comprising a second heat exchange fin, a second seal, and a heat exchange medium permeability channel, wherein two second seals are opposite to each other and are separately connected to the second heat exchange fin in an intersected manner, and the heat exchange medium permeability channel is disposed on a surface of the second heat exchange fin, wherein the first heat exchange core and the second heat exchange core are connected in a stacked manner, a first air duct is formed in the first heat exchange core, and a second air duct is formed in the second heat exchange core;

a first air inlet and a first air outlet of the first air duct are completely staggered from a second air inlet and a second air outlet of the second air duct, wherein the heat exchange medium permeability channel comprises a plurality of permeability pipes arranged at intervals; and a heat exchange medium supply pipe connected to an inlet of the permeability pipes.

18. The modular indirect evaporation cooling system according to claim 17, further comprising a pump; and wherein a first port of the pump is connected to a main supply pipe, and a second port of the pump is connected to a main return pipe.

19. The modular indirect evaporation cooling system according to claim 17, wherein a shape of the first heat exchange fin is the same as a shape of the second heat exchange fin, and a projection of the second seal on the first heat exchange fin is located between the two first seals.

20. The modular indirect evaporation cooling system according to claim 17, wherein at least one of the permeability pipes extend in a bending manner.

* * * * *